United States Patent [19]

Tsuji

[11] Patent Number: 4,612,624

[45] Date of Patent: Sep. 16, 1986

[54] DEMAND ESTIMATION APPARATUS

[75] Inventor: Shintaro Tsuji, Nagoya, Japan

[73] Assignee: Mitsubishi Denki Kabushiki Kaisha, Tokyo, Japan

[21] Appl. No.: 544,234

[22] Filed: Oct. 21, 1983

[30] Foreign Application Priority Data

Oct. 25, 1982 [JP] Japan ..... 57-187063
Oct. 25, 1982 [JP] Japan ..... 57-187064

[51] Int. Cl.[4] ..... G06G 7/12

[52] U.S. Cl. ..... 364/581; 187/29 R; 364/436; 364/554; 364/493

[58] Field of Search ..... 364/581, 575, 554, 572, 364/605, 733, 734, 436, 492, 493; 187/29 R

[56] References Cited

U.S. PATENT DOCUMENTS

| | | | |
|---|---|---|---|
| 3,659,085 | 4/1972 | Potter et al. | 364/581 |
| 3,805,032 | 4/1974 | Ross | 364/581 |
| 3,851,157 | 11/1974 | Ellis | 364/581 |
| 3,972,470 | 8/1976 | Takagi | 364/492 |
| 4,007,341 | 2/1977 | Sourgens et al. | 364/581 |
| 4,044,860 | 8/1977 | Kaneko et al. | 187/29 R |
| 4,117,538 | 9/1978 | Shrader et al. | 364/581 |
| 4,161,027 | 7/1979 | Russell | 364/492 |
| 4,289,397 | 9/1981 | Itzakan | 364/605 |
| 4,370,717 | 1/1983 | Hummert et al. | 364/436 |
| 4,418,795 | 12/1983 | Trosky et al. | 364/436 X |
| 4,524,418 | 6/1985 | Araya et al. | 364/436 |

*Primary Examiner*—Errol A. Krass
*Assistant Examiner*—Joseph L. Dixon
*Attorney, Agent, or Firm*—Leydig, Voit & Mayer, Ltd.

[57] ABSTRACT

A demand estimation apparatus wherein one cycle of a demand fluctuating substantially cyclically is divided into a plurality of sections having predetermined time widths, the demand is measured by cumulating demand measurements taken a varying number of times for each section and assigning an increasing weighting parameter for successively newer measured values, an estimated demand for each section is calculated based on the measured values for the section and a weight coefficient, and the weight coefficient is changed in accordance with the number of times of cumulation of demand measurements.

7 Claims, 16 Drawing Figures

DEMAND ESTIMATION APPARATUS

BACKGROUND OF THE INVENTION

This invention relates to improvements in an apparatus for estimating a demand such as a traffic volume or an electric power load.

The traffic volume of elevators in a building, the electric power load of a power station, or the like (hereinbelow, simply termed "demand") fluctuates irregularly when closely observed within a period of one day, but presents similar aspects for the same time zones when observed over several days. In, for example, an office building, elevator passengers on their way to their office floors crowd on the first floor during a short period of time in the time zone in which they attend offices in the morning. In the first half of the lunch hour, many passengers go from the office floors to a restaurant floor, while in the latter half thereof, many passengers go from the restaurant floor to the office floors. In addition, many passengers go from the office floors to the first floor in the time zone in which they leave the offices in the evening. The volumes of traffic in the up direction and in the down direction are nearly equal in the daytime time zones other than mentioned above, while the volume of traffic becomes very small throughout the nighttime.

In order to deal with the traffic in the building changing in this manner by means of a limited number of elevators, the elevators are usually operated under group supervision. When a hall call is registered anew, it is tentatively assigned to respective elevators, and the waiting times of all hall calls, the possibility of the full capacity of passengers, etc., are predicted so as to select from among the elevators the optimum one to respond to the new hall call. In order to execute such predictive calculations, traffic data peculiar to each building is required. For example, data on the number of passengers who get on and off the cage of each elevator at intermediate floors is required for predicting the possibility of full capacity. When such traffic data which changes every moment is stored each time, an enormous memory capacity is necessitated, which is not practical. Usually, the required memory size is reduced by dividing the operating period of time in one day into several time zones and storing only the average traffic volumes of the respective time zones. After the completion of the building, however, there is a possibility that traffic data will change in accordance with changes in personnel organization in the building, and hence, it is difficult to obtain good traffic data with which the demand can be predicted accurately. For this reason, a system has been developed, for example as disclosed in copending application Ser. No. 473,359 filed Mar. 8, 1983 now U.S. Pat. No. 4,567,566 and U.S. Pat. No. 4,524,418 wherein traffic conditions in the building are detected so as to sequentially improve the traffic data.

More specifically, the operating period of time in one day is divided into K time zones (hereinbelow, termed "sections"), and a time (hereinbelow, termed "boundary") by which a section k−1 and a section k are bounded is denoted by $t_k$ (k=2, 3, . . ., K). Times $t_l$ and $t_{k+l}$ are the starting time and end time of the elevator operation, respectively. The average traffic volume $P_k$ (l) of the section k on the l-th day is given by the following Equation (1):

$$P_k(l) = \frac{1}{t_{k+1} - t_k}\begin{bmatrix} X_k^u(l) \\ X_k^d(l) \\ Y_k^u(l) \\ Y_d^d(l) \end{bmatrix} \quad (1)$$

Here, $X_k^u$ (l) is a column vector of F−1 dimensions (where F denotes the number of floors) the elements of which are the number of passengers to get on cages in the up direction at respective floors in the time zone k of the l-th day. Similarly, $X_k^d$ (l), $Y_k^u$ (l) and Yhd $k^k$ (l) are column vectors which indicate the number of passengers to get on the cages in the down direction, the number of passengers to get off the cages in the up direction and the number of passengers to get off the cages in the down direction, respectively. The average traffic volume (hereinbelow, termed "average demend") $P_k$ (l) is measured by a passenger-number detector which utilizes load changes during the stoppage of the cages of the elevators and/or industrial television, ultrasonic wave, or the like.

First, the case where the representative value of the average demand $P_k$ (l) of each time zone is sequencially corrected in a case where the boundary $t_k$ is fixed is considered.

It is thought that the columns {$P_k$ (1), $P_k$ (2), . . .}of the average demands occurring daily will disperse in the vicinity of a certain representative value $P_k$. Since the magnitude of the representative value $P_k$ is unknown, it needs to be estimated by any method. In this case, there is the possibility that the magnitude of the representative value $P_k$ will change. The representative value is therefore predicted by taking a linear weighted average given in Equations (2) and (3) below, whereby more importance is attached to the average demand $P_k$ (l) measured latest, than to the other average demands $P_k$(1), $P_k$ (2), . . . and $P_k$ (l−1).

$$\hat{P}_k(l) = (1 - a)^l P_k(0) + \sum_{i=1}^{l} \lambda_i P_k(i) \quad (2)$$

$$\lambda_i = a(1 - a)^{l-i} \quad (3)$$

Here, $\hat{P}_k$ (l) is the representative value which has been predicted from the average demands $P_k$ (l), ..., and $P_k$ (l) measured till the l-th day, and $P_k$ (O) is an initial value which is set at a suitable value in advance. $\lambda_i$ denotes the weight of the average demand $P_k$ (i) measured on the i-th day, and this weight changes depending upon a parameter a. More specifically, an increase in the value of the parameter a results in an estimation in which more importance is attached to the latest measured average demand $P_k$ (l) than to the other average demands $P_k$ (1), ... and Pk(l−1), and in which the predictive representative value $\hat{P}_k$ (l) quickly follows up the change of the representative value $P_k$. However, when the value of the parameter a is too large, it is feared that the predictive representative value will change too violently in a manner to be influenced by the random variation of daily data. Meanwhile, Equations (2) and (3) can be rewritten as follows:

$$\hat{P}_k(l) = (1-a)\hat{P}_k(l-1) + a\,P_k(l) \quad (4)$$

$$\hat{P}_k(O) = P_k(O) \quad (5)$$

In accordance with the above Equation (4), there is the advantage that the weighted average of Equation (2) can be calculated without storing the observation values $P_k(i)(i=1, 2, ..., l-1)$ of the average demands in the past.

However, even in case of a demand which fluctuates cyclically, when the demand is observed over a long term, the representative value $P_k$ thereof might change greatly without remaining constant. By way of example, the traffic volume of elevators in a building is small at first after the completion of the building because there are comparatively few residents. The traffic volume increases little by little with the lapse of time, but some period is taken before the traffic volume becomes stable. In addition, in case of a building for rent, even when a considerable period of time has lapsed after the completion of the building, the residents sometimes change suddenly. Also in this case, the representative value $P_k$ of the demand changes.

In a case where, even when the magnitude itself of the representative value $P_k$ of the demand has changed greatly as described above, the predictive representative value $\hat{P}_k(l)$ of the representative value $P_k$ of the demand is calculated by the use of the parameter a which is set at a small value so as to avoid the influence of random variations in daily data, and therefore cannot follow changes in the representative value $P_k$ quickly and, therefore, greatly deviates from the actual demand. In consequence, the calculations of the waiting time and the possibility of full capacity being wrongly predicted arises, and the elevators are not group-supervised as intended. Conversely, when the parameter a is set at a large value so as to permit the predictive representative value $\hat{P}_k(l)$ to quickly follow the representative value $P_k$, the predictive representative value $\hat{P}_k(l)$ changes violently due to the influence of random variation in daily data during the stable period of the representative value $P_k$, so that similar inconveniences arise.

SUMMARY OF THE INVENTION

This invention improves the drawbacks described above, and has for its object to provide a demand estimation apparatus wherein among the measurement values of a demand in each section, a new one is weighted more than an old one, the new measurement value being then used, and once a predetermined condition such as an increase in the number of times of cumulation of demand measurements has held, the degree of the weighting of the new measurement value is changed, whereby the demand can be estimated at high precision.

DESCRIPTION OF THE PREFERRED EMBODIMENT

Now, an embodiment of this invention will be described with reference to FIGS. 1–10.

Figure 1:
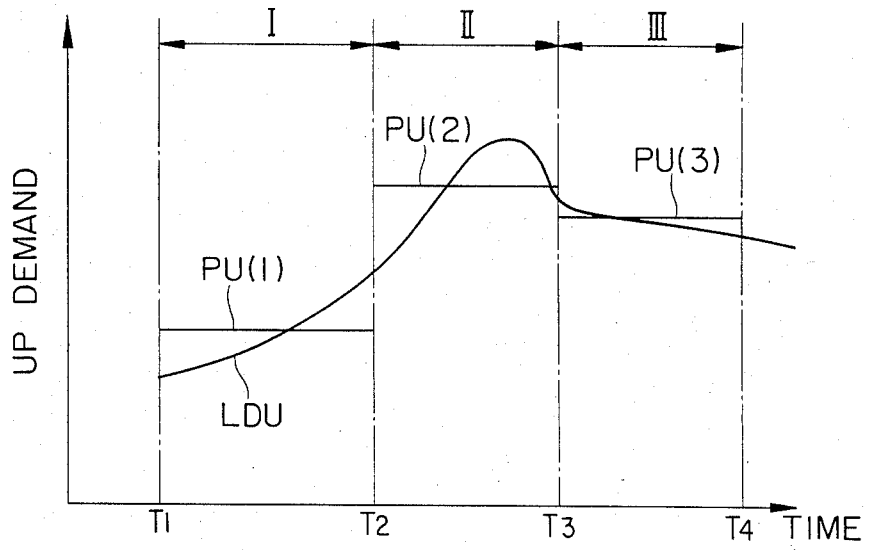
FIG. 1 is a diagram of an up direction demand curve showing an embodiment in which a demand estimation apparatus according to this invention is applied to elevators.
Figure 2:
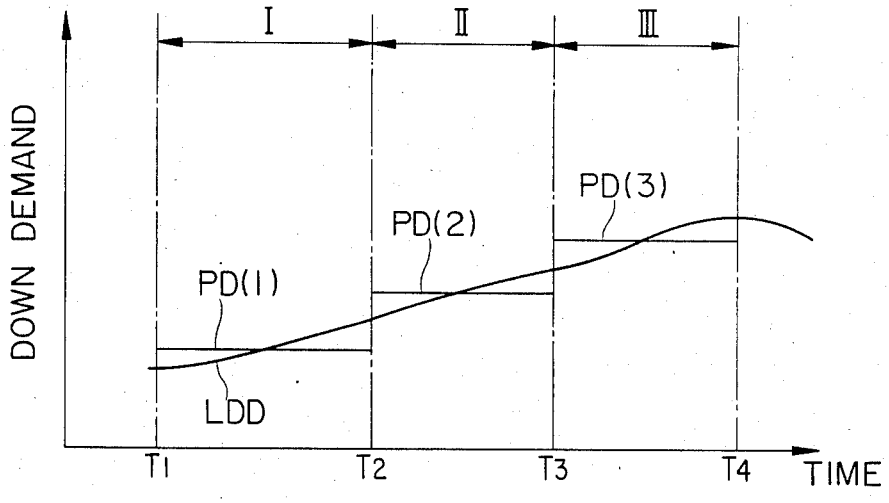
FIG. 2 is a diagram of a down direction demand curve in the embodiment.

In FIGS. 1 and 2, LDU indicates an up direction demand curve which is obtained in such a way that the numbers of persons who move in the up direction at predetermined times are measured and totaled for all floors, whereupon the total value is cumulated every unit time DT (set at 5 minutes). Similarly, LDD indicates a down direction demand curve which corresponds to the down direction. T1 denotes the boundary which is the starting time of a section I, T2 the boundary between the section I and a section II, T3 the boundary between the section II and a section III, and T4 the boundary which is the end time of the section III. PU(1) and PD(1) designate an average up direction demand and an average down direction demand in the section I, respectively. They correspond to the average traffic volume $P_k(l)$ resulting when values obtained by cumulating the up direction demand LDU and the down direction demand LDD in the section I are respectively substituted into $X_k^u(l)$ and $X_k^d(l)$ in Equation (1), and $Y_k^u(l)=0$ and $Y_k^d(l)=0$ and are assumed. Likewise, PU(2) and PD(2) designate an average up direction demand and an average down direction demand in the section II respectively, while PU(3) and PD(3) designate an average up direction demand and an average down direction demand in the section III respectively.

Figure 3:
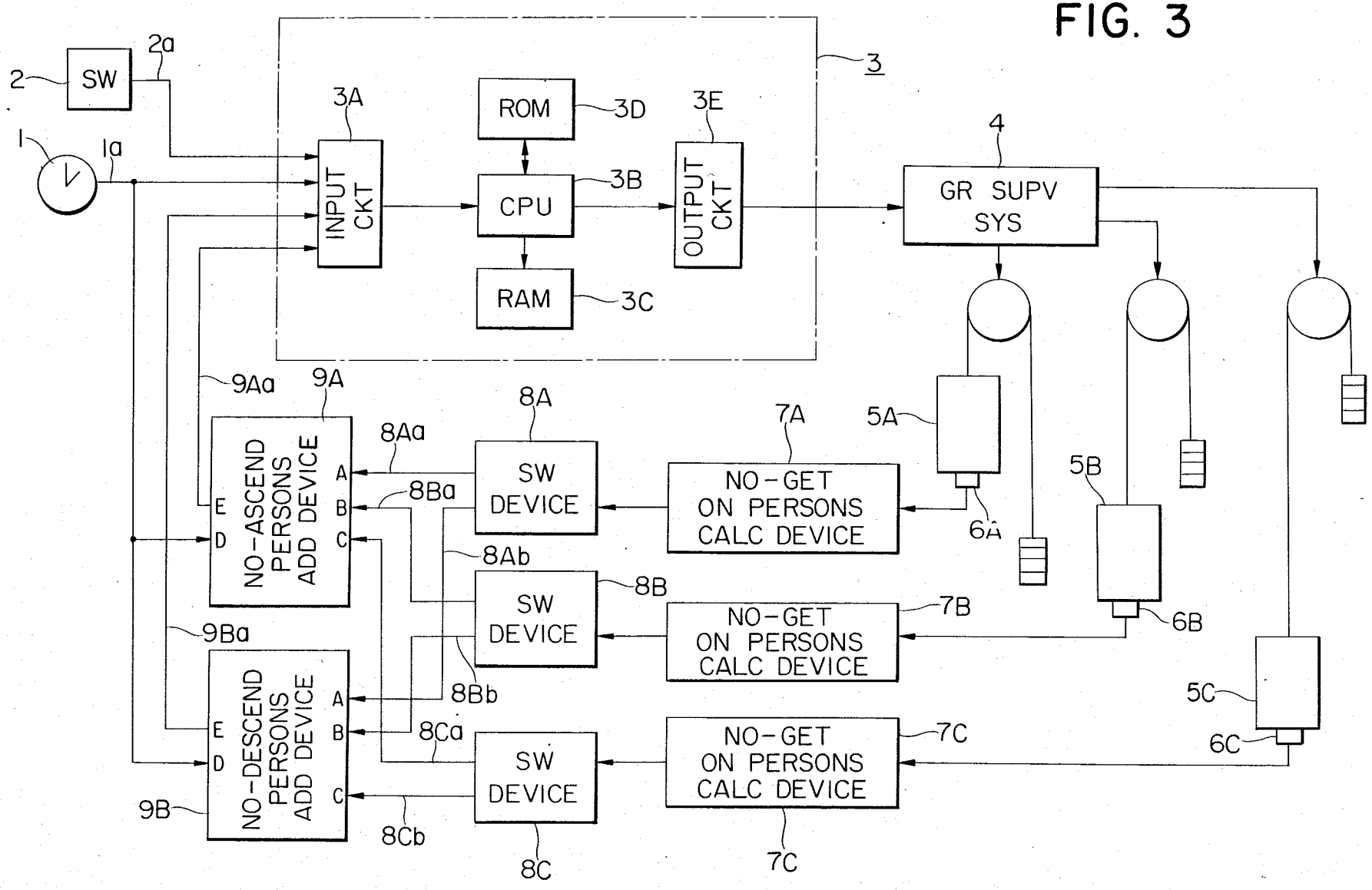
FIG. 3 is a block circuit diagram of the embodiment.

In FIG. 3, numeral 1 indicates clock means for producing a timing signal 1*a* each time a unit time DT lapses. Numeral 2 indicates a switch for appointing a weight coefficient, which is disposed on an operator's control panel and which produces a signal 2*a* corresponding to any of values 0–3 in accordance with respective positions of the switch 2. Shown at numeral 3 is a control device which basically comprises an electronic computer such as a microcomputer, wherein symbol 3A denotes an input circuit which consists of a converter for receiving an input, symbol 3B a central processing unit (hereinbelow, termed "CPU"), symbol 3C a random access memory (hereinbelow, termed "RAM") which stores data such as operated results, symbol 3D a read only memory (hereinbelow, termed "ROM") which stores programs and constant value data, and symbol 3E an output circuit which consists of a converter for delivering signals from the CPU 3B. Numeral 4 indicates a group supervisory system which group-supervises three elevator cages 5A–5C in accordance with signals from the control device 3. Symbols 6A–6C denote well-known number-of-persons detectors which are disposed on the cages 5A–5C to provide signals proportional to the numbers of passengers, respectively. Symbols 7A–7C denote number-of getting on persons calculation device (for example, as disclosed in U.S. Pat. No. 4,044,860) which store the minimum values of input signals when doors are open, and subtract the minimum values from the values of the input signals when the doors are closed, so as to calculate the numbers of persons who have gotten on the cages 6A–6C, respectively. Symbol 8A represents a change-over device which produces a number-of-up passengers signal 8A*a* during the asending operation of the elevator cage 5A, and a number-of-down passengers signal 8A*b* during the descending operation thereof. Likewise, symbols 8B and 8C represent change-over devices which produce number-of-up passengers signals 8B*a* and 8C*a* and number-of-down passengers signals 8B*b* and 8C*b*, respectively. A numbers-of-up passengers addition device 9A and a numbers-of-down passengers addition device 9B and respective inputs A–C and cumulate inputs D for the unit time DT so as to deliver the cumulative values as a number-of-up passengers signal 9A*a* and a number-of-down passengers signal 9B*a*, respectively.

Figure 4:
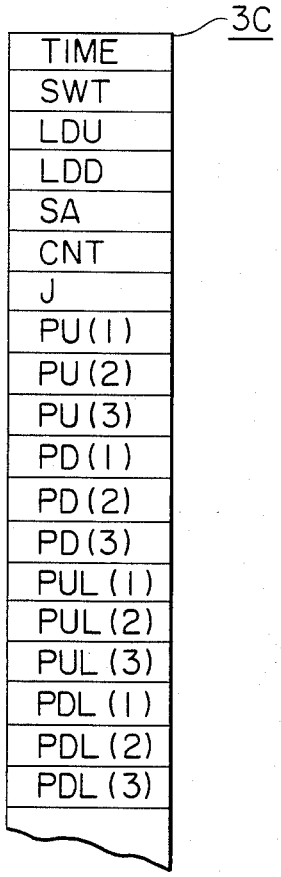
FIG. 4 is a diagram showing the content of a RAM in FIG. 3.
Figure 5:
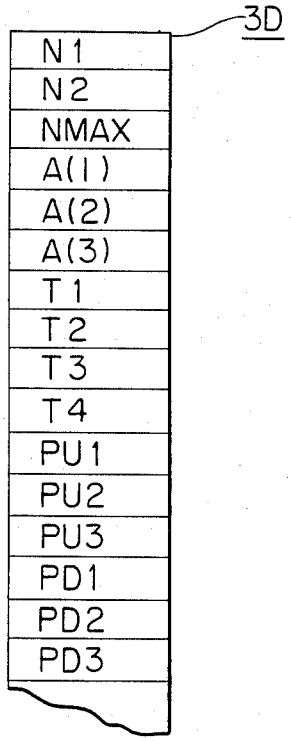
FIG. 5 is a diagram showing the content of a ROM in FIG. 3.

Reference is now had to FIGS. 4 and 5. Symbol TIME indicates a time obtained from the timing signal 1*a*, signal 2*a*. Symbol LDU indicates an up direction demand corresponding to the number-of-up passengers signal 9A*a*, while symbol LDD a down direction demand corresponding to the number-of-down passengers signal 9B*a*. Symbol SA designates a weighting parameter which corresponds to the parameter a in Equation (4), symbol CNT the number of times of cumulation by which the demand has been measured, and symbol J a counter which is used as a variable indicative of any of the sections I–III. Symbols PU(1)–PU(3) designate average up direction demands in the sections I–III respectively, while symbols PD(1)–PD(3) similarly designate average down direction demands. PUL(1)–PUL(3) designate predictive average up direction demands which correspond to representative values $\hat{P}_k$ (l) obtained by substituting the average up direction demands PU(1)–PU(3) into Equation (4), respectively, while symbols PDL(1)–PDL(3) similarly designate predictive average down direction demands. Constant values N1, N2 and NMAX are respectively set at 30, 60 and 120 (times), while constant values A(1)–A(3) are respectively set at $\frac{1}{3}$, 1/6 and 1/9. Symbols T1–T4 indicate boundaries which are respectively set at 87 (=7:15), 99 (=8:15), 108 (=9:00) and 122 (=10:10). Symbols PU1–PU3 indicate the initial values of the predictive average up direction demands PUL(1)–PUL(3), which are respectively set at 65, 130 and 109 (passengers/5 minutes), while symbols PD1–PD3 indicate the initial values of the predictive average down direction demands PDL(1)–PDL(3), which are respectively set at 5, 7 and 20 (passengers/5 minutes).

Reference is now had to FIGS. 6–10. Numeral 11 designates an initializing program which sets the initial values of various data, numeral 12 an input program which accepts signals from the input circuit 3A and sets them in the RAM 3C, numeral 13 a weight coefficient setting program which alters and corrects a weight coefficient and sets the corrected weight coefficient, numeral 14 an up demand calculating program which calculates the average up direction demands PU(1)–PU(3) measured in the respective sections I–III, numeral 15 a down demand calculating program which similarly calculates the average down direction demands PD(1) 14 PD(3), numeral 16 an average demand estimating program which calculates the predictive average up direction demands PUL(1)–PUL(3) and predictive average down direction demands PDL(1)–PDL(3) in the respective sections I–III, and numeral 17 an output program which delivers the predictive average up direction demands PUL(1)–PUL(3) and predictive average down direction demands PDL(1)–PDL(3) from the output circuit 3E. Numerals 21 and 22 indicate the operating steps of the initializing program 11, numerals 31–41 those of the weight coefficient setting program 13, numerals 51–58 those of the up demand calculating program 14, and numerals 61–65 those of the average demand estimating program 16.

The operations of this embodiment will now be described.

The number-of-persons detectors 6A–6C produce signals proportional to the numbers of passengers in the cages 5A–5C, respectively. The number-of-getting on person calculation devices 7A–7C calculate the numbers of persons who have gotten on the cages 5A–5C, respectively. These numbers of persons are classified into the numbers of persons in the up direction and in the down direction by the change-over devices 8A–8C, whereupon the numbers of persons in the respective directions are added by the number-of-up passengers addition device 9A and the number-of-down passengers addition device 9B. Thus, the number-of-up passengers signal 9A*a* and the number-of-down passengers signal 9B*a* are provided and sent to the input circuit 3A. In addition, the number of counts produced when the value "1" is counted every 5 minutes since a time 0 o'clock is provided as the timing signal 1*a* from the clock means 1, and it is inputted to the input circuit 3A.

On the other hand, when the control device 3 is first connected to a power source, the initializing program 11 is actuated. More specifically, at Step 21, the initial values PU1–PU3 are respectively set for the predictive average up direction demands PUL(1)–PUL(3), and the initial values PD1–PD3 are respectively set for the predictive average down direction demands PDL(1)–PDL(3). Subsequently, when the initial value "zero" is set for the number of times of cumulation CNT at Step 22, the control flow shifts to the input program 12.

The input program 12 is a well-known program which feeds the input signal from the input circuit 3A into the RAM 3C. By way of example, when the time is 8 o'clock, the input program reads the value 96 from the input circuit 3A and sets the time TIME of the RAM 3C at 96. Likewise, the switch signal 2*a* is received and set as the switch data SWT, the number-of-up passengers signal 9A*a* is received and set as the up direction demand LDU, and the number-of-down passengers signals 9B*a* is received and set as the down direction demand LDD.

Next, the weight coefficient setting program 13 is actuated. At Step 31, it is decided whether or not the first time zone in which the average demand is to be calculated has been reached. When the time TIME is equal to the boundary T1, the control flow proceeds to Step 32, whereat the number of times of cumulation CNT by which the demand has been measured is increased by 1 (one). At Step 33, it is decided whether or not the number of times of cumulation CNT has become equal to or greater than the upper limit value NMAX (=120 times). When the number of times of cumulation CNT is equal to or greater than the upper limit value, it is reset to zero at the next Step 34. Subsequently, what is appointed by the weight coefficient appointing switch 2 is decided at Step 35. When the switch data SWT is zero, it is indicated that the appointment by the switch 2 is invalid. In this case, the weight coefficient SA conforming to the number of times of cumulation CNT is set by Steps 36–40. More specifically, when the number of times of cumulation CNT <the constant value N1 (=30 times) holds at Step 36, the weight coefficient SA is set at the constant value A(1) ($=\frac{1}{3}$) at Step 37. When the constant value N1 (=30 times) ≦ the number of times of cumulation CNT <the constant value N2 (=60 times) is decided at Steps 36 and 38, the weight coefficient SA is set at the constant value A(2) (=1/6) at Step 39. Further, when the constant value N2 ≦ the number of times of cumulation CNT < the upper limite value NMAX holds, the weight coefficient SA is set at the constant value A(3) (=1/9) at Step 40. If the switch data SWT assumes any of values 1–3, it is expressed that the appointment by the switch 2 has priority, and a constant value A(SWT) conforming to the value of switch data SWT is set as the weight coefficient SA at Step 41. When the time TIME is unequal to the boundary T1 at Step 31, the above steps 32–41 are not executed, and the weight coefficient SA is not corrected.

In this way, according to the weight coefficient setting program 13, before the average demand is calculated every day, the number of times of cumulation CNT by which the demand has been measured is cumulated, and the weight coefficient is set by the appointment through the switch 2 or in accordance with the number of times of cumulation CNT. In addition, when the number of times of cumulation CNT has become, at least, equal to the upper limit value NMAX, it is reset to zero.

Next, the up demand calculating program 14 is actuated.

At Step 51, it is decided whether or not the time zone in which the average demand is to be calculated as been reached. When the time TIME is smaller than the boundary T1, the control flow proceeds to Step 52, at which all the average up direction demands PU(1-)-PU(3) are set at zero as the initializing operation for the calculation of the average demand. When the time TIME becomes equal to or greater than the boundary T1 at Step 51, the control flow proceeds to Step 53. When the time TIME is smaller than the boundary T2 here, the control flow proceeds to Step 54, at which the average up direction demand PU(1) of the section I is corrected by the use of the up direction demand LDU measured anew, so as to increase to the amount of the up direction demand per unit time DT as denoted by LDU/T2—T1). When the time TIME is T2 ≦TIME <T3, the control flow proceeds along Steps 53→55→56, at which the average up direction demand PU(2) of the section II is corrected in the same manner as at Step 54. Further, if the time TIME is T3 ≦TIME <T4, the control flow proceeds along Steps 55→57→58, at which the average up direction demand PU(3) of the section III is corrected in the same manner as at Step 54.

In this way, the average up direction demands PU(1-)-PU(3) of the sections I–III are sequentially corrected in the up demand calculating program 14.

Next, the down demand calculating program 15 is actuated. This program sequentially corrects the average down direction demands PD(1)–PD(3) of the sections I–III likewise to the up demand calculating program 14, and will not be further explained.

Next, the average demand estimating program 16 is actuated.

Only when the time TIME arrives at the boundary T4 which is the end time of the section III, the following Steps 62–65 are executed. At Step 62, the counter J is initialized to 1 (one). At Step 63, the predictive average up direction demand PUL(J) calculated till the preceding day is multiplied by (1−SA) and is added to the average up direction demand PU(J) just measured on the particular day as multiplied by SA, to set a predictive average up direction demand PUL(J) anew. Likewise, the predictive average down direction demand PDL(J) is set again. The value of the counter J is decided at Step 64. Unless it reaches 3, 1 (one) is added to the counter J at Step 65, whereupon the control flow returns to Step 63 so as to repeat the calculations of Step 63→Step 64→Step 65. When the demands have been calculated up to the section III, the value of the counter J becomes 3, and the program proceeds from Step 64 to its exit.

In this fashion, according to the average demand estimating program 16, the calculations are executed for correcting the predictive average up direction demands PUL(1)–PUL(3) and predictive average down direction demands PDL(1)–PDL(3) in the respective sections I–III every day.

Next, the output program 17 is actuated. It delivers from the output circuit 3E the predictive average up direction demands PUL(1)–PUL(3) and predictive average down direction demands PDL(1)–PDL(3) in the respective sections I–III calculated by the average demand program 16.

In the embodiment, the weight coefficient SA is set at a large value at the beginning after the completion of a building, and it is set at a smaller value gradually with increase in the number of times of cumulation CNT of the demand measurements. Therefore, the prediction of the demand quickly following up the change of the representative value $P_k$ of the demand is permitted at the beginning after the completion of the building. Moreover, the prediction of the demand which is not affected by the random variation of daily data is permitted about the time when the representative value $P_k$ of the demand has become stable.

In addition, when the number of times of cumulation CNT has exceeded the upper limit value, it is once reset to zero. Therefore, in a building in which the change of the representative value $P_k$ of the demand arises in a comparatively short period of time, a demand prediction having a comparatively good follow-up property is automatically effected in response to the change of the representative value $P_k$. In a case where the change of the demand has been clearly found, the predictive value of the demand should desirably be urgently caused to follow it up. In such case, the weight coefficient SA can be corrected according to the operator's judgement by operating the weight coefficient appointing switch 2. It is therefore possible to promptly predict the demand at a still higher precision.

Further, in the embodiment, even when the weight coefficient SA has been altered to a large value (that is, when the representative value $P_k$ of the demand has changed greatly), the new predictive value of the demand is corrected sequentially from the predictive value obtained till then. When, in such case, the weight coefficient is set so as to become 1 (one) only in the first demand prediction immediately after the alteration of the weight coefficient SA to the large value, the measurement value $P_k$ (l) of the first demand prediction mentioned above becomes the predictive value $\hat{P}_k$ (l) as it is. It is therefore to be understood that the follow-up property becomes still better.

Although, in the embodiment, three values have been set as the set values of the weight coefficient SA based on the number of times of cumulation CNT or the switch data SWT, they are not restrictive thereto. Values in a number suited to the particular building may be chosen.

Further although the same weight coefficient SA has been used for the respective sections, different weight coefficients SA may well be set for the respective sections. This realizes a demand prediction of high precision for each section.

Furthermore, a demand prediction having a good follow-up property can also be effected in such a way that, each time a demand is measured, a measured result obtained till then is compared with a result measured this time, and when any sign of the change of the representative value $P_k$ of the demand has been detected as the result, the number of times of cumulation CNT is reset to zero by way of example.

It is to be understood that the invention is also applicable to a case of predicting demands in four or more sections or a case of predicting demands for respective floors (in individual directions).

The invention is not restricted to the case of estimating the traffic volume of elevators, but it is also applicable to cases of estimating various demands such as electric power demand and water quantity demand.

As set forth above, according to this invention, among the measurement values of a demand in each section, a new one is weighted more than an old one, the new measurement value being then used, and once a predetermined condition such an an increase in the number of times of cumulation of demand measurements has held, the degree of the weighting of the new measurement value is changed, so that both when the representative value of the demand has changed and when it is stable, the demand can be estimated at high precision.

There will now be described a practicable emodiment on how to use the switch 2.

Figure 11:
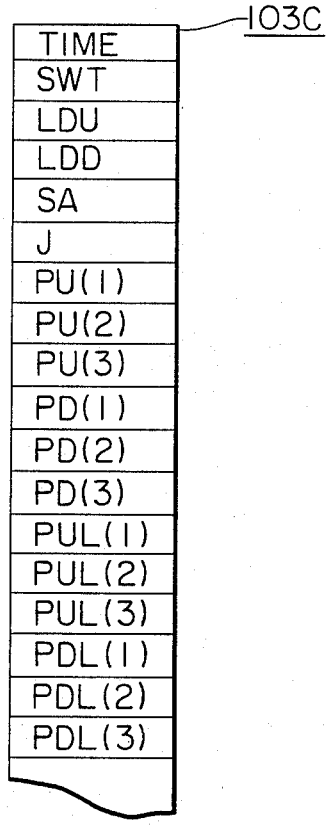
FIG. 11 is a diagram showing the content of the RAM in FIG. 3.
Figure 12:
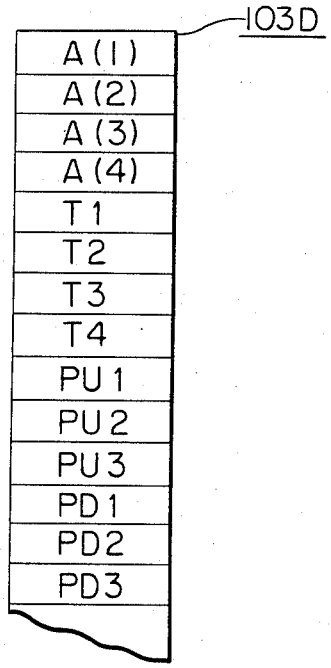
FIG. 12 is a diagram showing the content of the ROM in FIG. 3.
Figure 13:
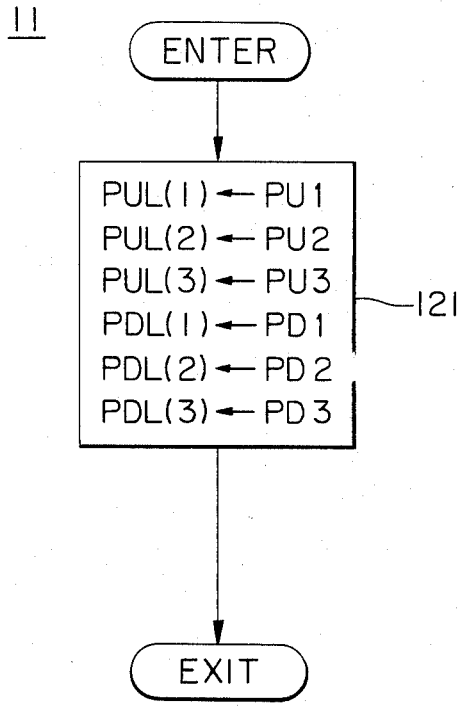
FIG. 13 is a flow diagram of the operations of the initializing program in FIG. 6.
Figure 14:
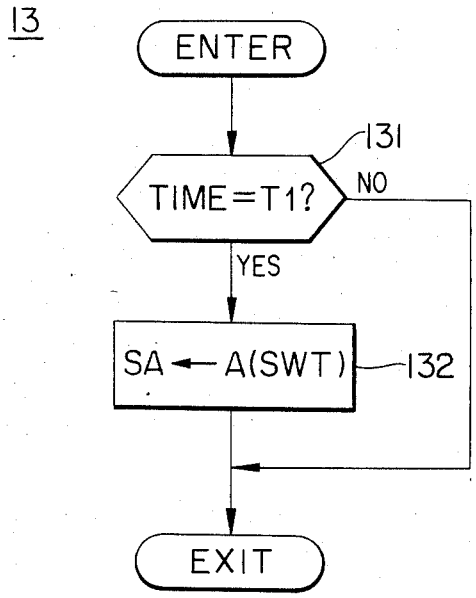
FIG. 14 is a flow diagram of the operations of the weight coefficient setting program in FIG. 6.
Figure 15:
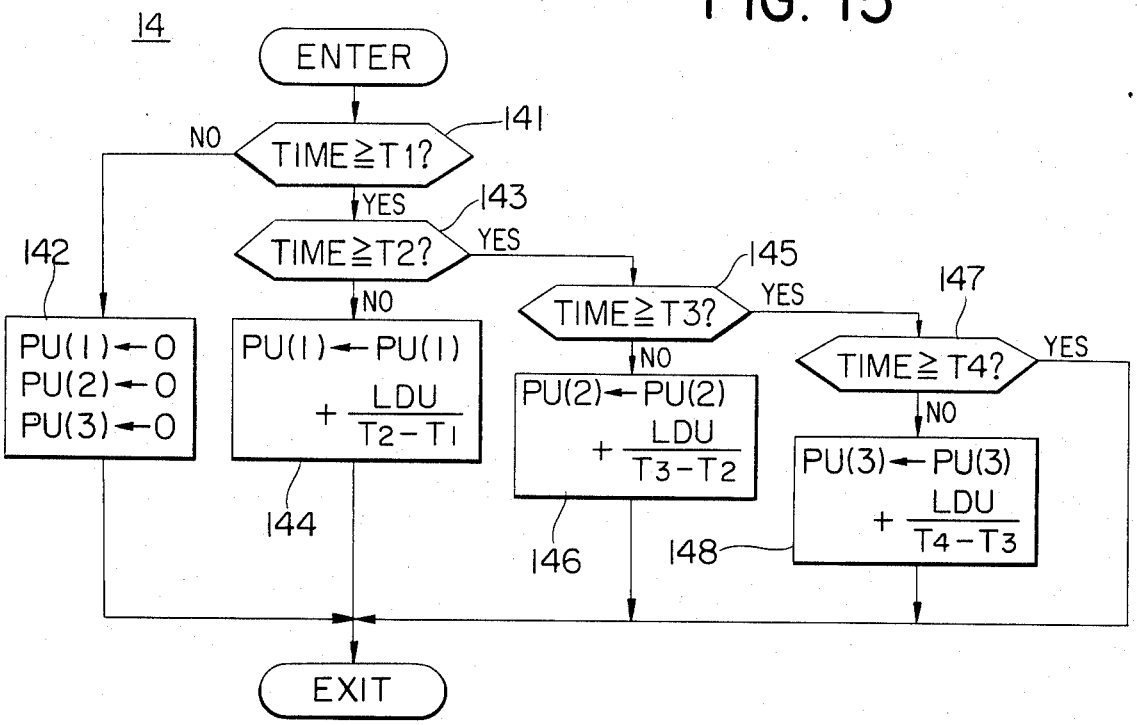
FIG. 15 is a flow diagram of the operations of the up demand calculating program in FIG. 6.
Figure 16:
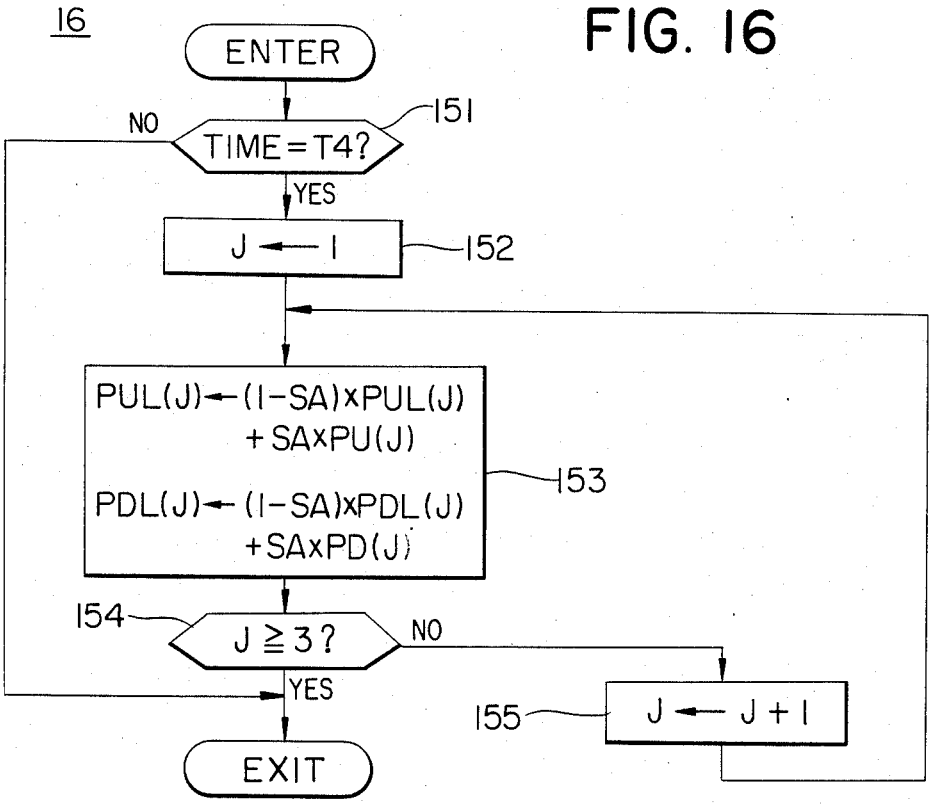
FIG. 16 is a flow diagram of the operations of the average demand estimating program in FIG. 6.

FIGS. 11 and 12 correspond to the RAM 3C and ROM 3D shown in FIGS. 4 and 5, respectively. In a RAM 103C, the same data as in the RAM 3C except for the data CNT in this RAM 3C is stored. In a ROM 103D, the same data as in the ROM 3D except for the data N1 N2 NMAX and A(1)–A(3) in this ROM 3D is stored. In the ROM 103D, the values of data A(1)–A(4) are respectively set at 0, 0.05, 0.1 and 0.2.

Figure 6:
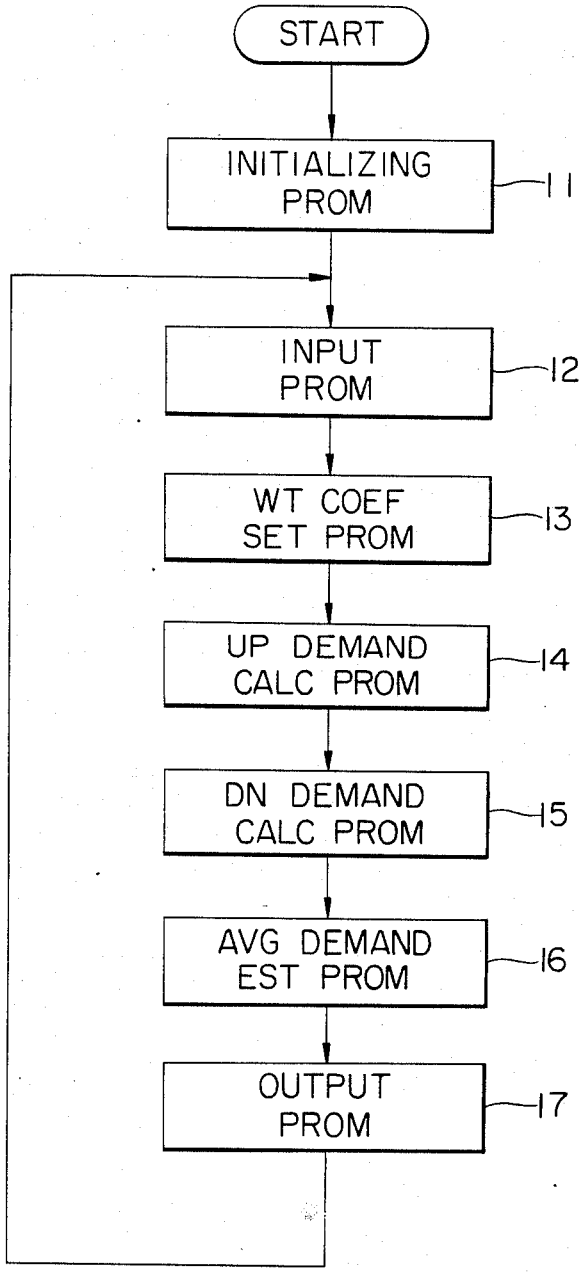
FIG. 6 is a diagram showing the general flow of programs.
Figure 7:
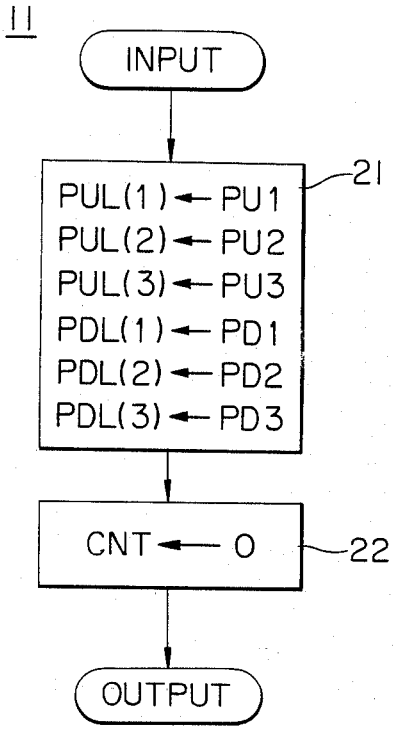
FIG. 7 is a flow diagram of the operations of an initializing program in FIG. 6.
Figure 8:
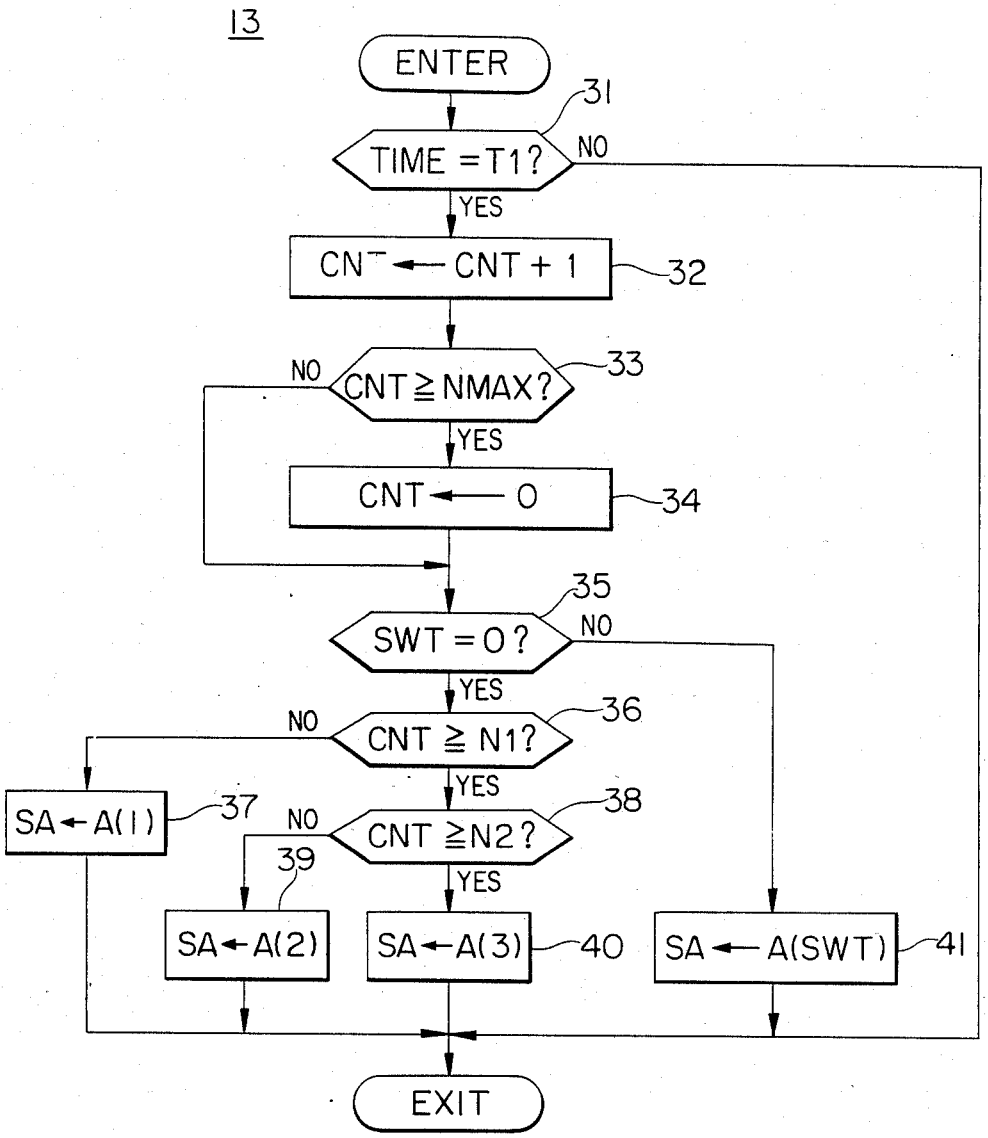
FIG. 8 is a flow diagram of the operations of a weight coefficient setting program in FIG. 6.
Figure 9:
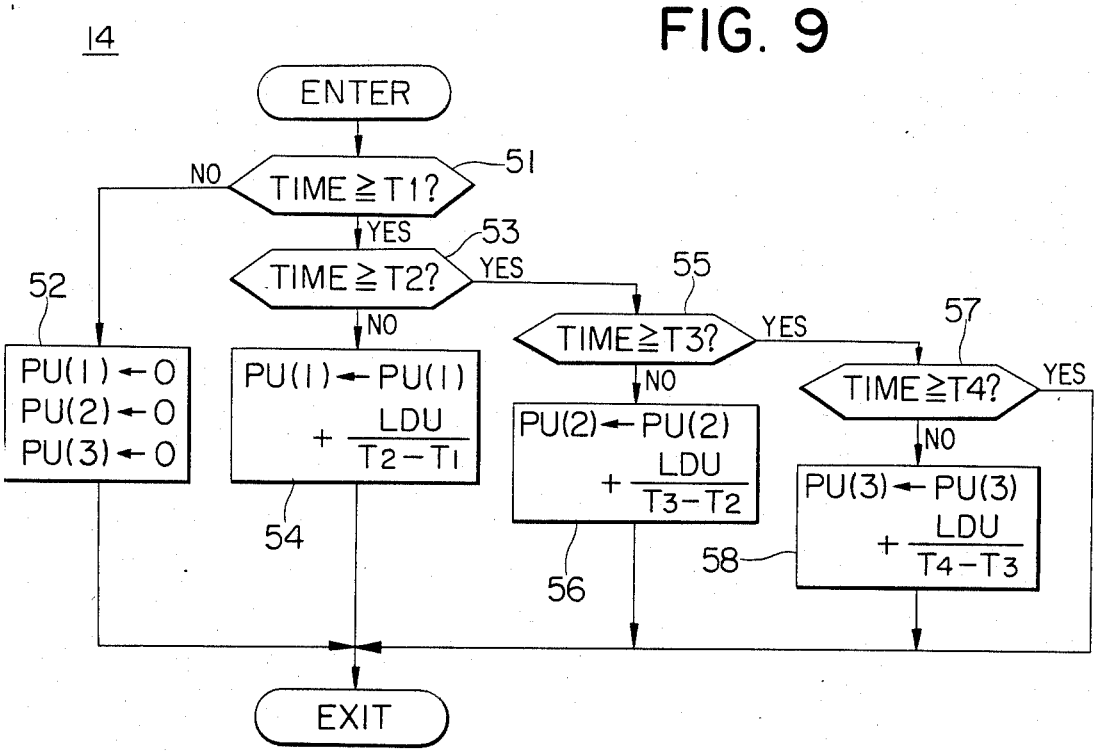
FIG. 9 is a flow diagram of the operations of an up demand calculating program in FIG. 6.
Figure 10:
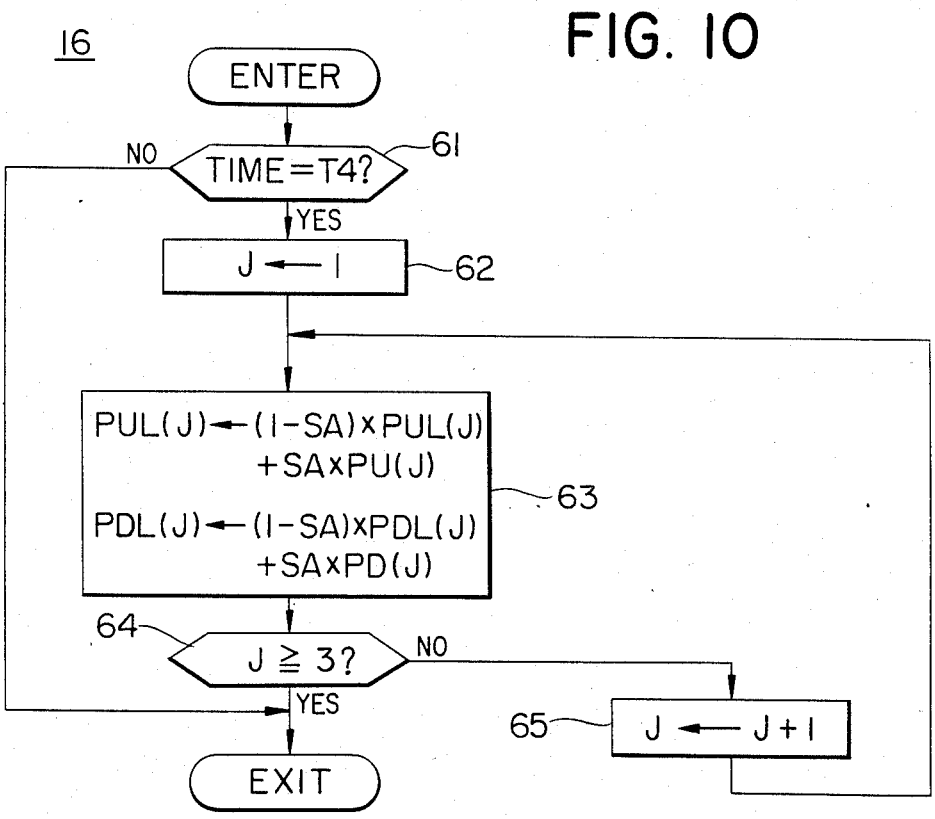
FIG. 10 is a flow diagram of the operations of an average demand estimating program in FIG. 6.

FIGS. 13 to 16 show the details of some of the programs in FIG. 6. Numeral 121 indicates the operating step of the initializing program 11, numerals 131 and 132 the operating steps of the weight coefficient setting program 13, numerals 141–148 the operating steps of the up demand calculating program 14, and numerals 151–155 the operating steps of the average demand estimating program 16.

The operations of the second embodiment will be explained below.

The number-of-persons detectors 6A–6C produce signals proportional to the numbers of passengers on the cages 5A–5C, respectively. The number-of-getting on persons calculations devices 7A–7C calculate the numbers of persons who have gotton on the cages 5A–5C, respectively. These numbers of persons are classified into the numbers of persons in the up direction and in the down direction by the change-over devices 8A–8C, whereupon the numbers of persons in the respective directions are added by the number-of-up pasengers addition device 9A and the number-of-down passengers addition device 9B. Thus, the number-of-up passengers signal 9A*a* and the number-of-down passengers signal 9B*a* are provided and sent to the input circuit 3A. In addition, the number of counts produced when the value "1" is counted every 5 minutes since a time 0 o'clock is provided as the timing signal 1*a* from the clock means 1, and it is inputted to the input circuit 3A.

On the other hand, when the control device 3 is first connected to a power source, the initializing program 11 is actuated. More specifically, at Step 121, the initial values PU1–PU3 are respectively set for the predective average up direction demands PUL(1)–PUL(3), and the intial values PD1–PD3 are respectively set for the predictive average down direction demands PDL(1)–PDL(3). Subsequently, the control flow shifts to the input program 12.

The input program 12 is a well-known program which feeds the input signal from the input circuit 3A into the RAM 3C. By way of example, when the time is 8 o'clock, the input program reads the value 96 from the input circuit 3A and sets the time TIME of the RAM 3C at 96. Likewise, the switch signal 2*a* is received and set as the switch data SWT, the number-of-up passengers signal 9A*a* is received and set as the up direction demand LDU, and the number-of-down passengers signal 9B*a* is received and set as the down direction demand LDD.

Next, the weight coefficient setting program 13 is actuated. At Step 131, it is decided whether or not the first time zone in which the average demand is to be calculated has been reached. When the time TIME is equal to the boundary T1, the control flow proceeds to Step 132, whereat a constant value A(SWT) corresponding to the value of the switch data SWT is set as the weight coefficient SA. For example, when it is clearly known that a demand whose magnitude differs from the ordinary one will be measured on account of a national holiday, the beginning or end of the year, or the like, the operator sets the switch 2 at 1 (one). Since, at this time, the value of the switch data SWT also becomes 1 (one), the constant value A(1) (=0) is set as the weight coefficient SA. On the other hand, when it is known that a demand whose magnitude differs from the ordinary one will be measured though temporarily, on account of a conference, assembly or the like held in the building, the operator sets the switch 2 at 2 or 3. At this time, the constant value A(2) (=0.05) or constant value A(3) (=0.1) which is smaller than the constant value A(4) (=0.2) in the ordinary operation of the elevators is set as the weight coefficient SA. In this manner, when it is previously known that an unusual demand magnitude will be measured, the value of the weight coefficient SA is set at zero or the smaller value than the usual one in accordance with the extent or period to or during which the measurement value will differ, whereby any bad influence on the estimation value of the demand can be prevented. When the time TIME is unequal to the boundary T1 at Step 131, the above step 132 is not executed, and the weight coefficient SA is not corrected.

In this way, according to the weight coefficient setting program 13, before the average demand is calculated every day, the weight coefficient is corrected in accordance with the appointment through the switch 2.

Next, the up demand calculating program 14 is actuated.

At Step 141, it is decided whether or not the time zone in which the average demand is to be calculated has been reached. When the time TIME is smaller than the boundary T1, the control flow proceeds to Step 142, at which all the average up direction demands PU(1-)-PU(3) are set at zero as the initializing operation for the calculation of the average demand. When the time TIME becomes equal to or greater than the boundary T1 at Step 141, the control flow proceeds to Step 143. When the time TIME is smaller than the boundary T2 here, the control flow proceeds to Step 144, at which the average up direction demand PU(1) of the section I is corrected by the use of the up direction demand LDU measured anew, so as to increase to the amount of the up direction demand per unit time DT as denoted by LDU/(T2 -T1). When the time TIME is T2 ≦TIME <T3, the control flow proceeds along Steps 143→145→146, at which the average up direction demand PU(2) of the section II is corrected in the same manner as at Step 144. Further, if the time TIME is T3 ≦TIME <T4, the control flow proceeds along Steps 145→147→148, at which the average up direction demand PU(3) of the section III is corrected in the same manner as at Step 144.

In this way, the average up direction demands PU(1-)-PU(3) of the sections I-III are sequentially corrected in the up demand calculating program 14.

Next, the down demand calculating program 15 is actuated. This program sequentially corrects the average down direction demands PD(1)-PD(3) of the sections I-III likewise to the up demand calculating program 14, and will not be explained in detail.

Next, the average demand estimating program 16 is actuated.

Only when the time TIME arrives at the boundary T4 which is the end time of the Section III, the following Steps 152-155 are executed. At Step 152, the counter J is initialized to 1 (one). At Step 153, the predictive average up direction demand PUL(J) calculated till the preceding day is multiplied by (1−SA) and is added to the average up direction demand PU(J) just measured on the particular day as multiplied by SA, to set a predictive average up direction demand PUL(J) anew. Likewise, the predictive average down direction demand PDL(J) is set again. The value of the counter J is decided at Step 154. Unless it reaches 3, 1 (one) is added to the counter J at Step 155, whereupon the control flow returns to Step 153 so as to repeat the calculations of Step 153→Step 154→Step 155. When the demands have been calculated up to the section III, the value of the counter J becomes 3, and the program proceeds from Step 154 to its exit.

In this fashion, according to the average demand estimating program 16, the calculation are executed for correcting the predictive average up direction demands PUL(1)-PUL(3) and predictive average down direction demands PDL(1)-PDL(3) in the respective sections I-III every day.

Next, the output program 17 is actuated. It delivers from the output circuit 3E the predictive average up direction demands PUL(1)-PUL(3) and predictive average down direction demands PDL(1)-PDL(3) in the respective sections I-III calculated by the average demand program 16.

Although, in the embodiment, three values have been set as the set values of the weight coefficient SA, they are not respective thereto. Values in a number suited to the particular building may be set.

Further, although the same weight coefficient SA has been used for the respective sections, different weight coefficients SA may well be set for the respective sections. This realizes a demand prediction of high precision for each section.

Further, it is to be understood that the invention is also applicable to a case of predicting demands in four or more sections or a case of predicting demands for respective floors (in individual directions).

The invention is not restricted to the case of estimating the traffic volume of elevators, but it is also applicable to cases of estimating various demands such as electric power demand and water quantity demand.

As set forth above, according to the second embodiment, the estimation value of a demand is obtained in accordance with the measurement value of the demand in each section, and the extent of use of the measurement value of the demand is selected in accordance with the appointment of a switch, so that even when clearly a demand magnitude different from an ordinary one will be measured, the demand magnitude during the ordinary operation can be precisely estimated without being affected by the different demand magnitude.

What is claimed is:

1. A demand estimation apparatus for controlling machines wherein a cycle of a cyclically fluctuating demand is divided into a plurality of sections of given time widths comprising:

means for measuring the demand in each section by cumulating demand meaurements taken a varying number of times for each section and producing measured demand values with an increasing weighting parameter for successively newer measured values;

means for determining an estimated value for the demand in each section on the basis of the measured value of the demand in each section and a weight coefficient; and weighting setting means to change the weight coefficient for the estimated demand values for a given section in accordance with the number of times of cumulation of demand measurements for said given section varying from a preset lower limit value to a preset upper limit value; and when the number of times of cumulation of the demand measurement for a given section has reached the preset upper limit value, the number of times of cumulation is reset to the preset lower limit whereupon the weight coefficient is changed.

2. A demand estimation apparatus as defined in claim 1 wherein, as the number of times of cumulation of the demand measurements becomes larger for a given section, the weight coefficient is made smaller.

3. A demand estimation apparatus for controlling machines wherein a cycle of a cylically fluctuating demand is divided into a plurality of sections of given time widths comprising:

means for measuring the demand in each section by cumulating demand measurements taken a varying number of times for each section and producing measured demand values with an increasing weighting parameter for successively new measured values;

means for determining an estimated value for the demand in each section on the basis of the measured value of the demand in each section and a weight coefficient; and weighting setting means to change the weight coefficient for the estimated demand values for a given section in accordance with the number of times of cumulation of demand measurements for said given section varying from a preset lower limit value to a preset upper limit value, said number of times of cumulation of demand measurements being reset to the preset lower limit value when the demand substantially changes.

4. A demand estimation apparatus for controlling machines wherein a cycle of a cyclically fluctuating demand is divided into a plurality of sections of given time widths comprising:

means for measuring the demand in each section by cumulating demand measurements taken a varying number of times for each section and producing measured demand values with an increasing weighting parameter for successively new measured values;

means for determining an estimated value for the demand in each section on the basis of the measured value of the demand in each section and a weight coefficient; and weighting setting means to change the weight coefficient for the estimated demand values for a given section in accordance with the number of times of cumulation of demand measurements for said given section varying from a preset lower limit value to a preset upper limit value and in accordance with an input signal produced by a switch connected to said weighting setting means.

5. A demand estimation apparatus as defined in claim 4, further comprising selection means connected to said switch for selecting the weight coefficient in accordance with a position of the switch.

6. A demand estimation apparatus as defined in claim 5 wherein, when under conditions different from predetermined conditions, the selection means selects a weight coefficient smaller than a coefficient set by said predetermined conditions.

7. A demand estimation apparatus as defined in claim 5 wherein the section means stops selecting the weight coefficient when said coefficient has reached a predetermined value.

* * * * *